US008622205B2

(12) United States Patent
Ramsey

(10) Patent No.: US 8,622,205 B2
(45) Date of Patent: Jan. 7, 2014

(54) POCKET STORABLE HAND TOWEL AND CASE

(76) Inventor: Alec Ramsey, San Luis Obispo, CA (US)

( * ) Notice: Subject to any disclaimer, the term of this patent is extended or adjusted under 35 U.S.C. 154(b) by 0 days.

(21) Appl. No.: 13/448,027

(22) Filed: Apr. 16, 2012

(65) Prior Publication Data

US 2013/0270127 A1 Oct. 17, 2013

(51) Int. Cl.

| | |
|---|---|
| ***A45C 11/00*** | (2006.01) |
| ***A47G 9/06*** | (2006.01) |
| ***B65D 33/00*** | (2006.01) |

(52) U.S. Cl.

USPC ..... 206/38; 206/581; 5/417; 383/4

(58) Field of Classification Search

USPC ..... 206/38, 38.1, 581, 812, 579; 5/417–419; 190/1, 102; 383/4, 111

See application file for complete search history.

(56) References Cited

U.S. PATENT DOCUMENTS

| | | | | |
|---|---|---|---|---|
| 2,105,319 | A * | 1/1938 | Hedden et al. | 383/4 |
| 2,293,530 | A * | 8/1942 | Beehler | 190/102 |
| 2,623,566 | A | 12/1952 | Kibler | |
| 4,861,632 | A | 8/1989 | Caggiano | |
| 5,244,278 | A * | 9/1993 | Robitaille | 383/4 |
| 5,372,414 | A * | 12/1994 | Lamonakis et al. | 206/812 |
| 5,372,429 | A | 12/1994 | Beaver, Jr. et al. | |
| 5,431,970 | A | 7/1995 | Broun et al. | |
| 5,439,154 | A * | 8/1995 | Delligatti | 383/4 |
| 5,639,532 | A * | 6/1997 | Wells | 206/581 |
| 6,135,273 | A | 10/2000 | Cuen | |
| 6,168,022 | B1 * | 1/2001 | Ward et al. | 206/581 |
| 6,531,197 | B2 | 3/2003 | Neteler | |
| 6,634,041 | B2 * | 10/2003 | Higashi et al. | 5/417 |
| 6,911,573 | B2 | 6/2005 | Chen et al. | |
| 7,076,816 | B1 * | 7/2006 | Nielsen et al. | 5/417 |
| 7,614,500 | B2 | 11/2009 | Chin | |
| 2007/0071369 | A1 | 3/2007 | Lin | |
| 2009/0080811 | A1 | 3/2009 | Stefanek et al. | |
| 2011/0155794 | A1 | 6/2011 | Russell | |
| 2011/0309089 | A1 | 12/2011 | Hundley | |

* cited by examiner

*Primary Examiner* — Bryon Gehman
(74) *Attorney, Agent, or Firm* — Felix L. Fischer

(57) ABSTRACT

A portable hand drying device incorporates a case foldable to form a vertex having an interior surface and a zipper closure for a peripheral edge. A multilayer liner having an outer permeable layer and an inner absorbing layer is attached to the interior surface of the case with hook and loop fastener and a towel, foldable to be encased within the case, is attached to the liner at the vertex.

9 Claims, 6 Drawing Sheets

POCKET STORABLE HAND TOWEL AND CASE

BACKGROUND INFORMATION

1. Field

Embodiments of the disclosure relate generally to the field of reusable towels and more particularly to a hand towel contained in a zipper closable case with a removable absorbent liner.

2. Background

It has been demonstrated that frequent hand washing provides significant benefits for personal hygiene and prevention of disease transmission. While facilities with water for hand washing are relatively easy to provide, the availability of towels or other means for drying the hands after washing can prove more complex. Reusable towels in a public facility context essentially defeat the hygienic purpose of washing the hands in the first place. While powered air dryers provide a sanitary means of drying the hands, the infrastructure requirements for such dryers and the environmental impact of the energy used in the dryers may not be desirable. Similarly, single use paper towels are wasteful and environmentally undesirable.

It is therefore desirable to provide a personal reusable hand towel which can be employed for hand drying multiple times without imparting moisture to clothing and which may be removed for drying and/or laundering.

SUMMARY

Embodiments disclosed herein provide a portable hand drying device incorporating a case foldable to form a vertex having an interior surface and a zipper closure for a peripheral edge. A multilayer liner having an outer permeable layer and an inner absorbing layer is removably attached to the interior surface of the case with a hook and loop fastener and a towel, foldable to be encased within the case, is attached to the liner at the vertex.

In certain example embodiments, the towel is removably attached to the liner with a hook and loop fastener or similar connection.

The features, functions, and advantages that have been discussed can be achieved independently in various embodiments of the present disclosure or may be combined in yet other embodiments further details of which can be seen with reference to the following description and drawings.

DETAILED DESCRIPTION

Embodiments disclosed herein provide a reusable hand towel removably stored in a case having a zipper closure and a removable multilayer absorbent lining. For the example embodiment, the hand towel is affixed at a portion of one edge to a vertex of the lining coincident with a vertex of the folding case. The multiply lining is retained within the case with hook and loop fasteners or similar restraints.

Figure 1:
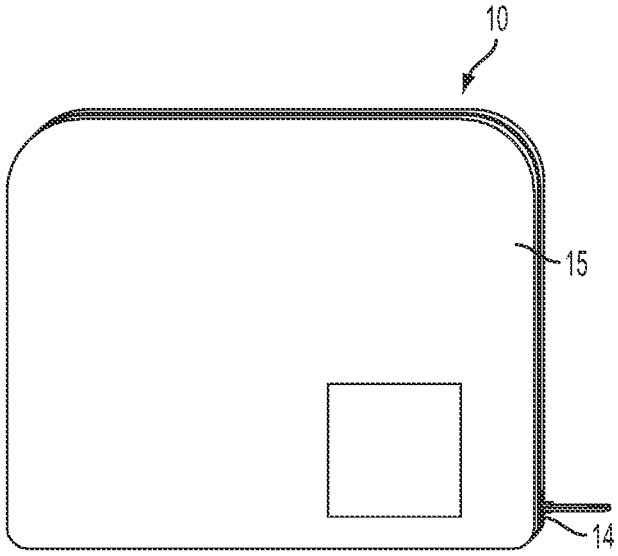
FIG. 1 is a perspective side view of an embodiment of the invention enclosed in the case.
Figure 2:
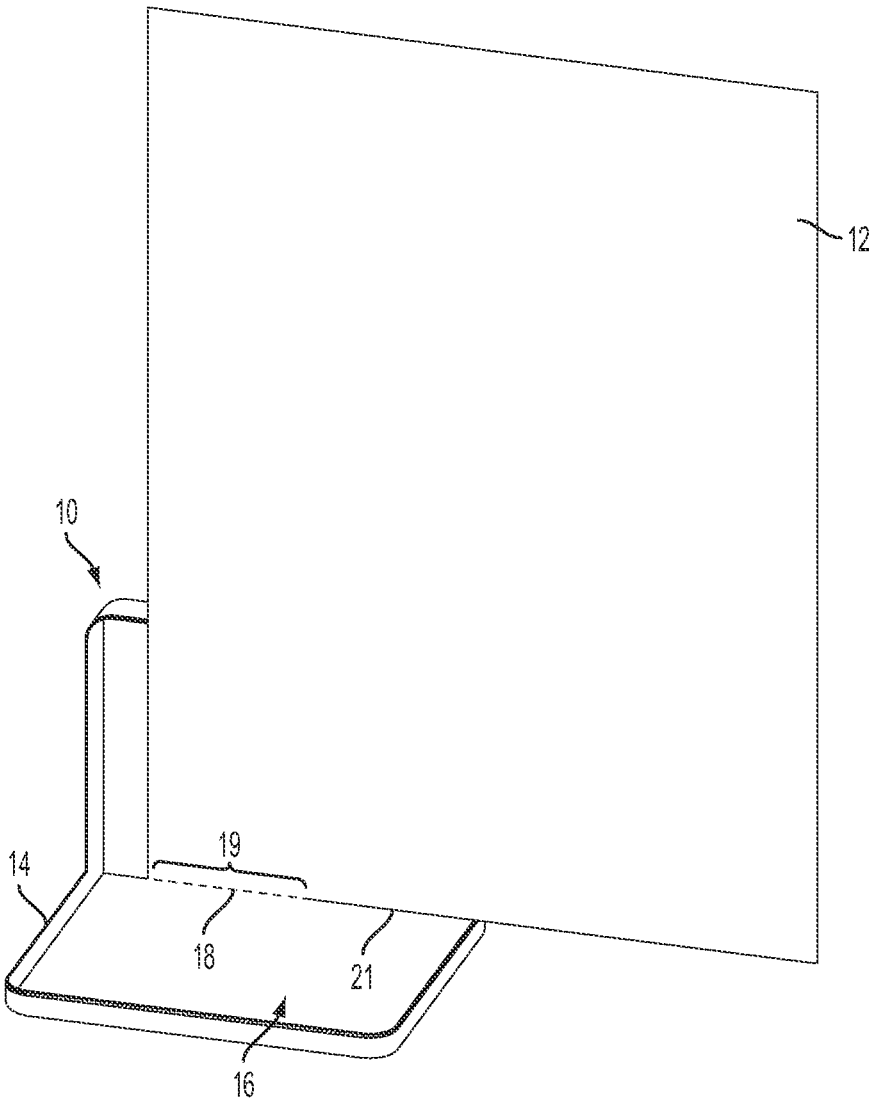
FIG. 2 is a perspective front view of the embodiment of FIG. 1 with the case opened and the towel expanded.
Figure 4:
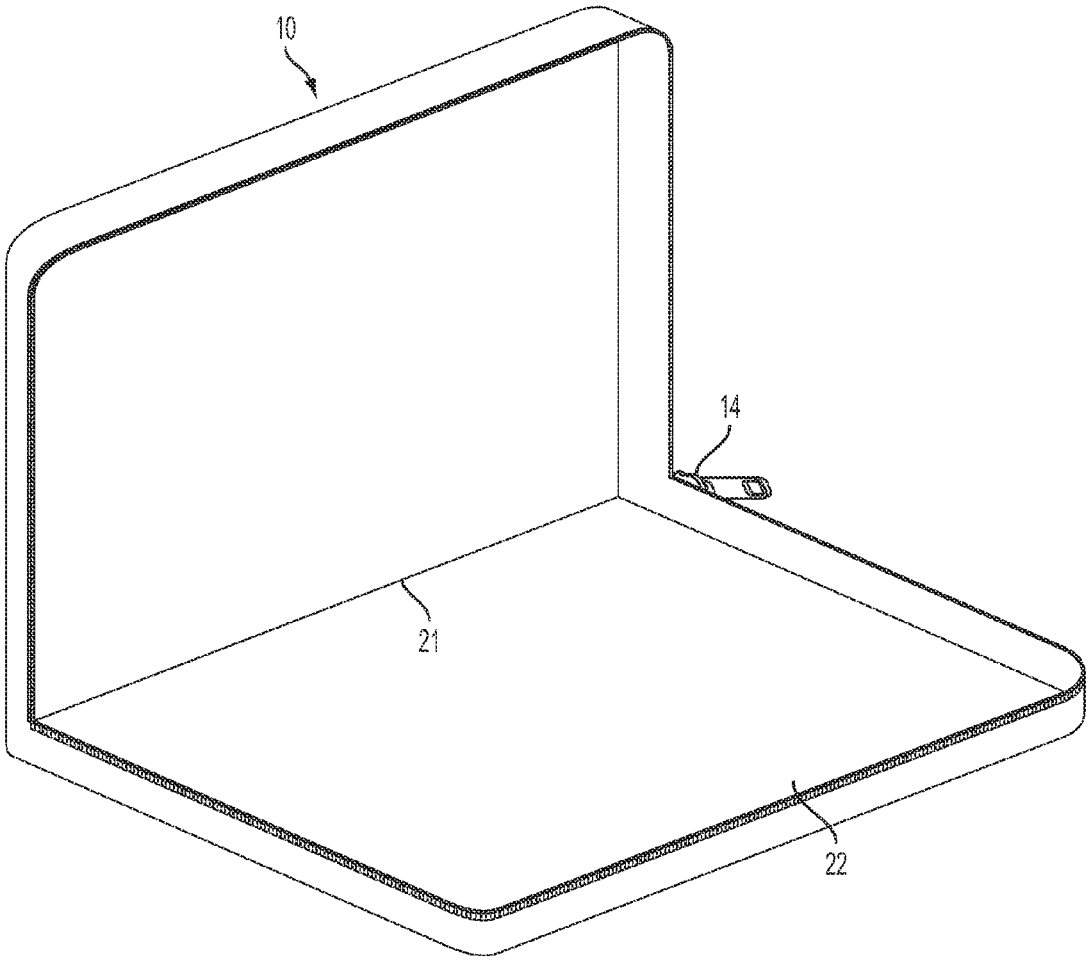
FIG. 4 is a perspective front view of the opened case with the towel and liner removed.

Referring to the drawings, FIG. 1 shows an example embodiment of a folding outer shell or case 10 which removably encloses a towel 12, seen in FIG. 2. The case 10 incorporates zipper 14 or other fastening system around a portion of a peripheral edge 11 for closing the case to envelope the towel 12. When the zipper is opened, the towel 12 may be unfolded from within the case for use as shown in FIG. 2. The case has water proof/water resistant sides 15 to prevent moisture from the towel bleeding through the case when folded into the case after use. The towel 12 is attached to and retained in the case by a liner 16. For an example embodiment, stitching 18 secures the towel along a portion 19 of one edge 20 to the vertex or folding crease 21 of the liner 16 which extends over an interior surface 22 of the case (best seen in FIG. 4) to encapsulate the towel when folded.

Figure 3:
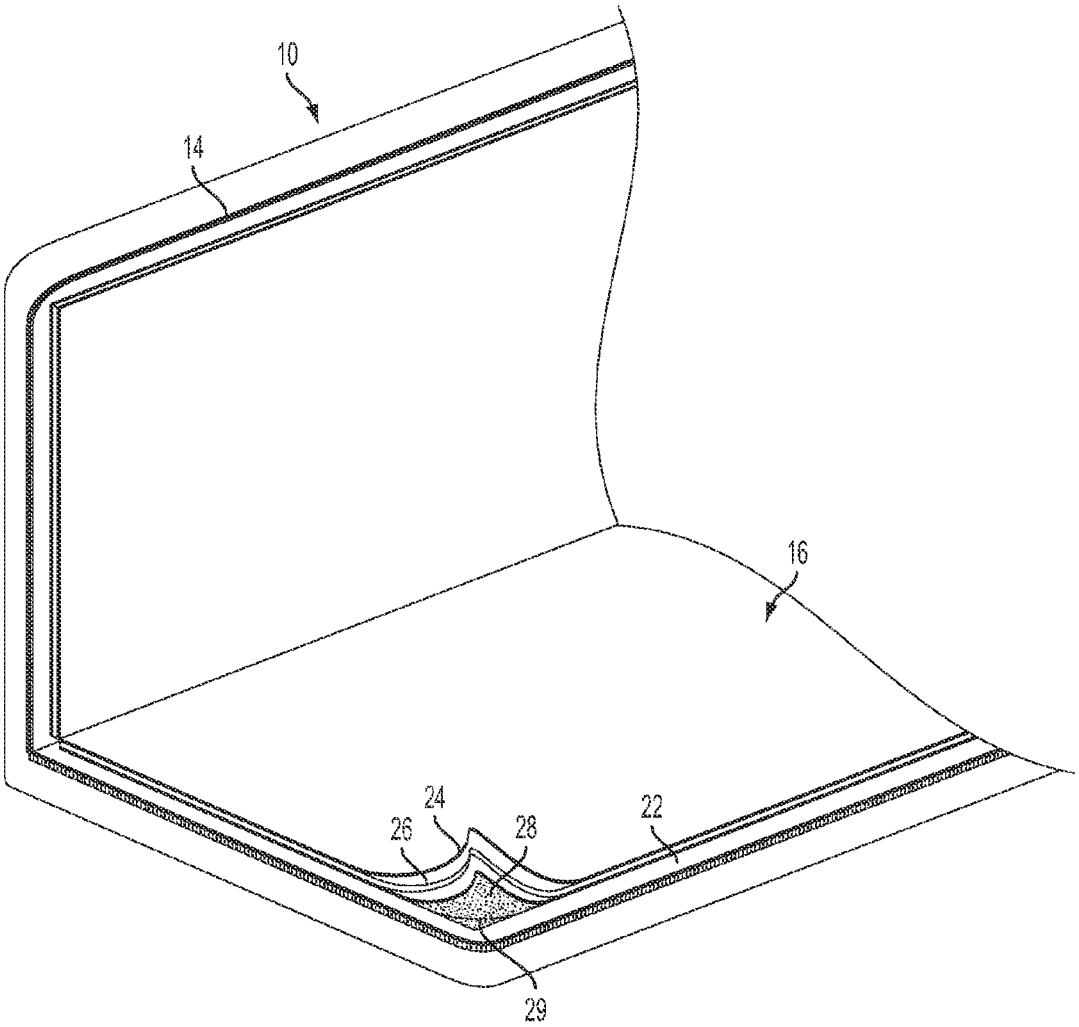
FIG. 3 is a perspective partially exploded front view of the liner assembly.

The liner 16 in the example embodiment is a multiple layer absorbent material, shown in FIG. 3, having a moisture permiable outer ply 24 to wick moisture from the towel 12 when the towel is folded into the case after use. An inner ply 26 in the liner provides absorbency in addition to the outer ply to hold moisture absorbed from the towel 12 when enclosed in the case 16. A hook and loop fastener (such as Velcro®) or similar securing structure with a first moiety 28 on the backside of the liner and a second moiety 29 on the interior surface 22 of the case 16, secures the liner into the case allowing removal of the towel and liner for laundering or more thorough drying between uses. By absorbing moisture from the towel between uses, the multilayer absorbent lining increases the drying efficiency of the towel. In alternative embodiments, a single layer liner may be employed.

Figure 5:
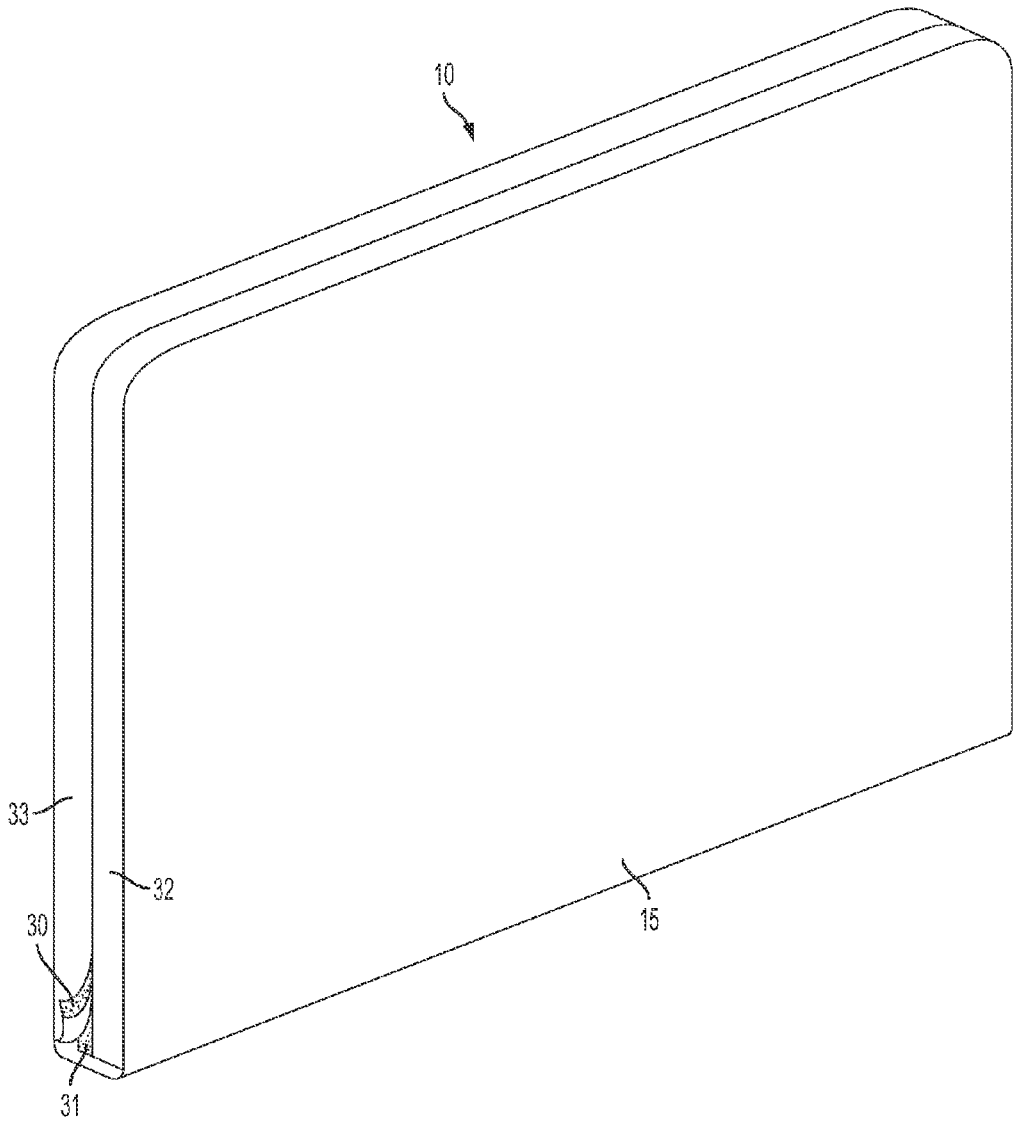
FIG. 5 is perspective partial front view of the closed case showing overlapping end elements or flaps for hook and loop fasteners; and, FIG. 6 is a perspective partial front view of the opened case showing an example removable attachment of the towel to the liner with hook and loop fasteners.

For example embodiments, the towel 12 is a quick drying microfiber shammy material. The case 16 is fabricated from vinyl or similar water resistant material or in alternative embodiments, is constructed of any durable but flexible material (like canvas or similar heavy fabric) and then backed with any polyester waterproof lining fabric. The inner ply 26 may be a second layer of microfiber shammy material or an alternate high density fabric with moisture retention capability. In an example embodiment, the outer ply 24 is a miocrofiber terry. The inner ply 26 is a thin sponge, felt, or microfiber suede material. Typically, aplastic zipper is employed for zipper 14 to prevent corrosion. In alternative embodiments, the case closure may be hook and loop fastener system with mating moieties 30, 31 in overlapping end elements 32, 33 or flaps, or the case may employ overlapping end elements for moisture retention and be fastened with an encircling band and/or clip or similar arrangement as shown in FIG. 5.

Figure 6:
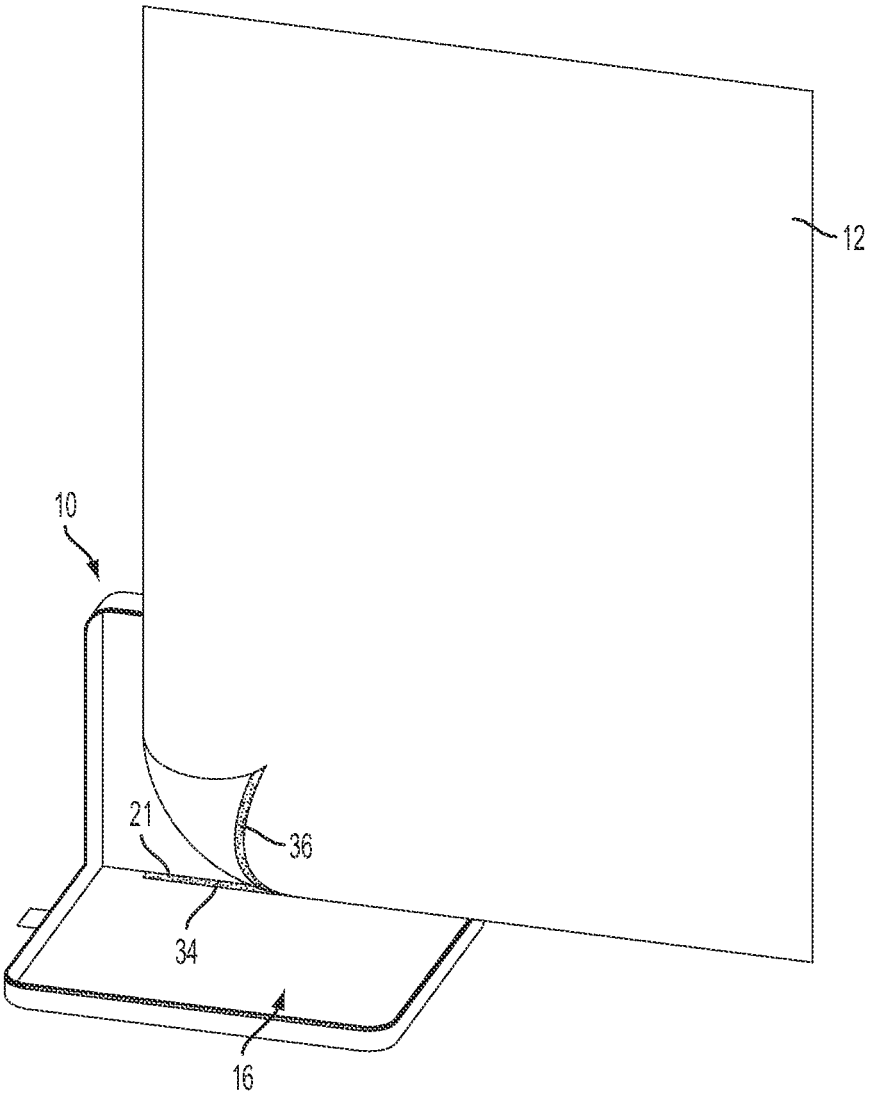

In alternative embodiments the towel 12 may be removably attached to the inner liner 16 using hook and loop fastener strips 34, 36 as first and second connector moieties at the mating edge with the liner vertex 21 as shown in FIG. 6 or may be attached at a corner with a button secured to the interior of the case and an eye in the towel.

The wicking absorbency of the liner 16 allows multiple uses of the towel before drying is required and the water resistant/water proof case 10 prevents moisture from the towel from reaching the interior of a pocket or purse of the user. When convenient, the towel 12 and liner 16 may be removed from the case 10 for drying (or washing by hand or in a washing machine and then drying). Drying may be accomplished by hanging on a clothes line or hanger or by machine drying. The liner and towel are then reattached inside the case to be available for the next use.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A portable hand drying device comprising:

a case having an interior surface and a closure for a peripheral edge;

a towel foldable to be encased within the case and removably attached to the case; and a liner removably attached to the interior surface of the case, said towel attached at a portion of an edge to the liner wherein the liner has multiple layers comprising an outer permeable layer and an inner absorbing layer.

2. The portable hand drying device as defined in claim 1 wherein the liner further includes a fastening moiety engaging a mating moiety on the interior surface of the case.

3. The portable hand drying device as defined in claim 1 wherein the towel is removably attached to the liner with a first connector moiety on the portion of the edge and a second connector moiety on the liner.

4. The portable hand drying device as defined in claim 3 wherein the case is foldable to form a vertex and the second connector moiety is adjacent the vertex.

5. The portable hand drying device as defined in claim 1 wherein the closure is a zipper.

6. The portable hand drying device as defined in claim 1 wherein the case incorporates overlapping end elements for moisture retention.

7. The portable hand drying device as defined in claim 6 wherein the closure is a hook and loop fastener.

8. A portable hand drying device comprising:

a case foldable to form a vertex having an interior surface and a zipper closure for a peripheral edge;

a multilayer liner having an outer permeable layer and an inner absorbing layer removably attached to the interior surface of the case with a hook and loop fastener;

a towel foldable to be encased within the case and attached to the liner at the vertex.

9. The portable hand drying device as defined in claim 8 wherein the towel is removably attached to the liner with a first connector moiety on a portion of an edge of the towel and a second connector moiety on the liner proximate the vertex.

* * * * *